US009363612B2

(12) United States Patent
Meier

(10) Patent No.: US 9,363,612 B2
(45) Date of Patent: Jun. 7, 2016

(54) METHOD FOR OPERATING A HEARING DEVICE AND A HEARING DEVICE

(75) Inventor: Hilmar Meier, Zurich (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 13/994,326

(22) PCT Filed: Dec. 20, 2010

(86) PCT No.: PCT/EP2010/070191
§ 371 (c)(1),
(2), (4) Date: Jun. 14, 2013

(87) PCT Pub. No.: WO2011/027004
PCT Pub. Date: Mar. 10, 2011

(65) Prior Publication Data

US 2013/0272553 A1 Oct. 17, 2013

(51) Int. Cl.
*H04R 25/00* (2006.01)
*H04R 1/10* (2006.01)

(52) U.S. Cl.
CPC ..... *H04R 25/43* (2013.01); *H04R 25/55* (2013.01); *H04R 1/1091* (2013.01); *H04R 2225/41* (2013.01); *H04R 2420/01* (2013.01)

(58) Field of Classification Search
CPC .... H04R 25/43; H04R 25/505; H04R 25/407; H04R 2225/41; H04R 2225/39; H04R 2460/07
USPC ..... 381/56, 312, 314, 315
See application file for complete search history.

(56) References Cited

U.S. PATENT DOCUMENTS 4,920,570 A 4/1990 West et al.
2002/0044669 A1 * 4/2002 Meyer et al. ..... 381/314

(Continued)

FOREIGN PATENT DOCUMENTS

EP 0 064 042 A1 11/1982
EP 1 443 803 A2 8/2004

(Continued)

OTHER PUBLICATIONS

International Search Report for PCT/EP2010/070191 dated Sep. 14, 2011.

(Continued)

*Primary Examiner* — Jesse Elbin
(74) *Attorney, Agent, or Firm* — Pearne & Gordon LLP

(57) ABSTRACT

The present invention proposes a method for operating a hearing device capable of receiving a plurality of input signals (i1, . . . , i5). The method comprises the steps of extracting source identification information embedded in one or more of the input signals (i1, . . . , i5), wherein the source identification information identifies a signal source ($S_1, \ldots, S_N$) from which a particular input signal ($i_1, \ldots, i_5$) originates, and/or extracting audio type information embedded in one or more of the input signals ($i_1, \ldots, i_5$), wherein the audio type information provides an indication of the type of audio content present in a particular input signal ($i_1, \ldots, i_5$), selecting from the plurality of input signals ($i_1, \ldots, i_5$) one or more selected signals to be processed ($u_1, \ldots, u_M$), processing the selected signals ($u_1, \ldots, u_M$), and generating an output signal (o) of the hearing device by said processing of the selected signals ($u_1, \ldots, u_M$). Thereby, the step of selecting is at least partly dependent on the extracted source identification information and/or the extracted audio type information, and/or wherein the step of processing is at least partly dependent on the extracted source identification information and/or the extracted audio type information. A corresponding hearing device is also disclosed.

15 Claims, 2 Drawing Sheets

(56) References Cited

U.S. PATENT DOCUMENTS

| | | | | |
|---|---|---|---|---|
| 2003/0133582 | A1 | 7/2003 | Niederdrank | |
| 2004/0175008 | A1 | 9/2004 | Roeck et al. | |
| 2010/0202637 | A1 * | 8/2010 | Cornelisse et al. | 381/314 |

FOREIGN PATENT DOCUMENTS

| | | | | |
|---|---|---|---|---|
| EP | 1 460 769 | A1 | 9/2004 | |
| EP | 1 653 773 | A2 | 5/2006 | |
| EP | 2 034 767 | A1 | 3/2009 | |
| EP | 2 182 741 | A1 | 5/2010 | |
| WO | WO 01/22790 | A2 | 4/2001 | |
| WO | WO2007/096792 | * | 8/2007 | H04S 3/00 |
| WO | 2008/071230 | A1 | 6/2008 | |

OTHER PUBLICATIONS

Written Opinion for PCT/EP2010/070191 dated Sep. 14, 2011.

* cited by examiner

METHOD FOR OPERATING A HEARING DEVICE AND A HEARING DEVICE

TECHNICAL FIELD

The present invention is related to a method for operating a hearing device as well as to a corresponding hearing device according to the pre-characterising part of claim 11. In the context of the present invention the term "hearing device" refers to hearing aids (alternatively called hearing instruments or hearing prostheses) used to compensate hearing impairments of hard of hearing persons as well as audio and communication devices used to provide sound signals to persons with normal hearing capability. Such hearing devices can be adapted to be worn at the ear, behind the ear or in the ear canal, and can also be anchorable to or implantable into a user's head. Furthermore, such hearing devices can comprise multiple separate units, for example two ear-level units of which one is worn at the left ear and the other is worn at the right ear, where for instance communication between these two ear-level units and/or other devices such as a mobile phone or a portable audio player takes place via a remote auxiliary unit such as a hub which acts as a communication relay. The term hearing device thus also encompasses a binaural hearing system including associated accessories such as a communication interface unit, e.g. Phonak's iCom, Oticon's ConnectLine or Siemens' Tek/miniTek, and a remote control unit.

BACKGROUND OF THE INVENTION

Modern hearing devices can be adapted to various acoustic surround situations as well as to a variety of signal sources with the help of different hearing programs. In this context the term "hearing program" refers to a specific set of parameters associated with the signal processing performed by the hearing device. The adaptation, i.e. the switching between different hearing programs, is performed by manually activating a switch at the hearing device or on a remote control, or automatically by the hearing device itself based on a suitable algorithm.

A programmable signal processing device capable of selecting a number of different signal processes to suit different sound situations automatically or by the user himself is disclosed in EP 0 064 042 A1.

A method for automatically recognising a momentary acoustic surround situation and for adjusting a hearing device according to the determined acoustic surround situation is known from WO 01/22790 A2. The known teaching is related to a very efficient algorithm with the aid of which the acoustic surround situation can be determined with a high reliability.

A method for detecting and automatically selecting an input signal in a hearing aid in which at least two analog input signals are available is described in EP 1 443 803 A2.

EP 1 653 773 A2 discloses a technique with which the best suited hearing program is selected after a certain input source has been detected and selected from a plurality of input sources.

In US 2002/0044669 A1 a hearing aid is proposed that automatically chooses a hearing program based on detecting whether it is located in the vicinity of an external transmitter.

A method for operating a hearing device capable of receiving a variety of input signals is described in WO 2008/071230 A1, wherein the parameters for controlling the processing of the hearing device are derived from information pertinent to the communication protocol used to transmit the input signal being processed.

SUMMARY OF THE INVENTION

It is an object of the present invention to further improve a method for operating a hearing device.

At least this object is achieved by the method according to claim 1. Preferred embodiments as well as a hearing device are given in the further claims.

The present invention provides a method for operating a hearing device capable of receiving a plurality of input signals, the method comprising the steps of:

- extracting source identification information embedded in one or more of the input signals, wherein the source identification information identifies a signal source from which a particular input signal originates, and/or extracting audio type information embedded in one or more of the input signals, wherein the audio type information provides an indication of the type of audio content present in a particular input signal;
- selecting from the plurality of input signals one or more selected signals to be processed;
- processing the selected signals; and
- generating an output signal of the hearing device by said processing of the selected signals;

wherein the step of selecting is at least partly dependent on the extracted source identification information and/or the extracted audio type information, and/or wherein the step of processing is at least partly dependent on the extracted source identification information and/or the extracted audio type information.

The connectivity of hearing devices to external units providing audio signals has only recently been dramatically improved with the availability of appropriate wireless communication technologies. The present invention takes this into account in view of the increasing proliferation of personal audio and communication devices, such as MP3 players, gaming devices, mobile phones, navigation units, ebook readers, personal digital assistants, remote companion microphones, etc., which can be linked to a hearing device. As a result of this increased connectivity, a hearing device must be able to optimally cope with a plurality of different audio signals originating from various signal sources. In order to do so, the present invention proposes to utilise source identification information and/or audio type information embedded in the signals being sent to a hearing device. Such source identification information can for instance include the following:

- media access control (MAC) address;
- international mobile subscriber identity (IMSI) number;
- mobile subscriber identity (MSIN) number;
- Internet protocol (IP) address;
- telephone number;
- person's or device's name;
- serial number;
- geographical position, e.g. coordinates or location address;

and such audio type information can for instance include the following:

- audio metadata, e.g. ID3 or APE tag;
- audio/video metadata, e.g. MPEG-7 description;
- radio data system (RDS) data.

Based on this kind of information the hearing device is able to optimally adjust its processing of the incoming signal(s) and/or its mode of operation. Thereby, the hearing device is not only able to distinguish between different types of communication links, such as for instance T-coil, FM or Bluetooth, used to send signals to the hearing device, but also detect which source is sending a signal, e.g. via a Bluetooth link, and what type of audio content is contained in that signal. So if a hearing impaired person is using a hearing device together with a plurality of companion microphones each assigned to a specific communication partner, the hearing device can be optimally adjusted according to the signal originating from each companion microphone, e.g. specifically to a woman's or a man's voice. Correspondingly, a signal from a personal audio player may contain different audio contents, e.g. music (including various genres such as classic or pop) or speech (such as audiobooks), at different times. The hearing device can then distinguish between the two based on the audio type information it extracts from the signal. Such a differentiation is not possible based on knowledge of the type of communication link alone, even when further information pertinent to a communication protocol being used to transmit a certain signal, such as the active Bluetooth profile (e.g. headset profile HSP or advanced audio distribution profile A2DP), is also taken into account as proposed in WO 2008/071230 A1.

In an embodiment of the method according to the present invention a hearing program is associated with one or more of the signal sources identifiable by the source identification information and/or with one or more of the audio types identifiable by the audio type information. This allows to apply a hearing program that is most suitable for handling the signal originating from a certain source and/or the type of audio content contained in a signal once the source identification information and/or the audio type information has been extracted from the signal without the necessity of any further signal analysis.

In a further embodiment of the method according to the present invention the associating of a hearing program with a signal source and/or with an audio type is performed prior to use of the hearing device by the user of the hearing device as part of a hearing device fitting process. Thereby, the person performing the fitting of the hearing device, such as for instance an audiologist, chooses the most appropriate hearing program for a certain signal source and/or audio type based on knowledge of what kind of audio signal this signal source provides and what kind of sounds are contained in this type of audio signal, such that the signal can be optimally processed by the hearing device according to the needs and desires of its user.

In a further embodiment of the method according to the present invention the associating of a hearing program with a signal source and/or with an audio type is modified dependent on user interaction with the hearing device during use of the hearing device. Thereby, the user of the hearing device is able to modify the behaviour of the hearing device relative to the behaviour programmed into the hearing device during the fitting process. This may be desirable if it turns out during use of the hearing device that another hearing program is more suitable for dealing with a signal from a certain signal source or for handling a certain audio type. If this is the case, the user will normally adjust the hearing device manually (i.e. through user interaction with the hearing device) and switch to a more suitable hearing program. The user can then for instance indicate to the hearing device that such a change is to be made permanently when certain source identification information and/or audio type information is detected. Alternatively, the hearing device can learn the user's preference over the course of time from the user's interaction with the hearing device in certain situations and then automatically apply a different hearing program than before when certain source identification information and/or audio type information is detected.

In a further embodiment of the method according to the invention the step of processing is at least partly dependent on a further step of analysing and classifying one or more of the selected signals into sound classes, wherein a hearing program is associated with each sound class. For signals where the source identification information and/or the audio type information cannot be extracted or cannot be associated with a specific signal source and/or audio type the sounds present in a signal are determined with the aid of a classifier.

In a further embodiment of the method according to the present invention the step of analysing and classifying takes into account the sound identification information and/or the audio type information extracted from the respective selected signal. By taking this information into account the sound classification process can be made more accurate and more reliable, and furthermore can be performed more rapidly and more efficiently. This approach is for instance useful in situations where the source identification information and/or the audio type information are rather crude and sound classification is necessary to determine the best hearing program to employ. Moreover, in situations where interference is added to the signal, yielding a signal which deviates from the signal indicated by the source identification information and/or the audio type information alone, benefits from additionally employing sound classification to determine the best hearing program to use.

In a further embodiment of the method according to the present invention the step of processing comprises modifying each of the selected signals according to the hearing program associated with the signal source identified by the source identification information embedded in the respective selected signal and/or the audio type identified by the audio type information embedded in the respective selected signal, thus yielding one or more modified signals, and forming a weighted sum of the one or more modified signals, wherein the weighting is at least partly dependent on at least one of the extracted source identification information, the extracted audio type information and the sound class. With this it is possible to optimally combine different audio signal types originating from different sources, e.g. the signal from the hearing device microphone picking up the surrounding sounds together with the sound from a remote companion microphone providing the voice signal of a communication partner located at a distance from the hearing device user. Depending on the preferences of the user the hearing device is programmed to treat these two signals differently, e.g. amplify the signal from the companion microphone beyond that of the surrounding sounds, in order to enhance the voice of the remote communication partner, whilst still enabling to hear what is going on in the user's proximity, thus ensuring his awareness of the surrounding environment.

In a further embodiment of the method according to the present invention the step of selecting is at least partly dependent on a selection priority list, wherein the selection priority list comprises assignments of priorities to the signal sources identifiable by the source identification information and/or the audio types identifiable by the audio type information and/or combinations of both, and/or that the processing of the selected one or more signals is at least partly dependent on a processing priority list, wherein the processing priority list comprises assignments of priorities to the signal sources identifiable by the source identification information and/or the audio types identifiable by the audio type information and/or combinations of both. Depending on the preferences of the user, which are manifested in the two priority lists, signals from certain sources or certain audio types can be handled preferentially over others. For instance when a telephone call is received it is immediately selected whilst the signal from an audio player which is currently being listen to by the user of the hearing device is deselected. Moreover, it is possible to allocate the available signal processing resources as well as the processing horsepower of the hearing device in dependence of the relative importance of the signals present given by their individual priority. For example, if the hearing programs chosen to handle the selected signals require more processing resources or power than available or can be provided by the processing means of the hearing device, signals with low priority will for instance not be processed or are processed with a less complex, suboptimal hearing program.

In a further embodiment of the method according to the present invention the assigning of priorities to the signal sources or the audio types or combinations of both as provided by the selection priority list and/or the processing priority list is performed prior to use of the hearing device by the user of the hearing device as part of a hearing device fitting process. The preferences of the user can thus be taken into account before the user starts to employ the hearing device.

In a further embodiment of the method according to the present invention the assigning of priorities to the signal sources or the audio types or combinations of both as provided by the selection priority list and/or the processing priority list is modified based on user interaction with the hearing device during use of the hearing device. This allows modifying the assigned priorities present in the hearing device based on how the user interacts with the hearing device in certain situations. If for instance the user does not want the hearing device to deselect the signal from an audio player when a telephone is received, he can indicate this to the device by manually selecting the signal from the audio player each time it is automatically deselected by the hearing device when a telephone call is received. The hearing device can also learn this behaviour by analysing the user's previous manual interventions, i.e. his interaction with the hearing device, in certain situations and then automatically adopting this desired behaviour in such situations in the future.

Furthermore, a hearing device is provided comprising:

input receiving means for receiving a plurality of inputs signals;

selecting means for selecting from the plurality of input signals one or more selected signals to be processed;

processing means for processing the selected signals; and output generating means for generating an output signal of the hearing device by said processing of the selected signals;

characterised by extracting means for extracting source identification information embedded in one or more of the input signals, wherein the source identification information identifies a signal source from which a particular input signal originates, and/or for extracting audio type information embedded in one or more of the input signals, wherein the audio type information provides an indication of the type of audio content present in a particular input signal;

wherein the extracting means and selecting means are operationally connected to one another for transferring extracted source identification information and/or audio type information, and/or wherein the extracting means and the processing means are operationally connected to one another for transferring extracted source identification information and/or audio type information.

An embodiment of the hearing device according to the present invention is further characterised in that the processing means provides a plurality of hearing programs, wherein at least one hearing program is selectable dependent on the extracted source identification information and/or the extracted audio type information.

A further embodiment of the hearing device according to the present invention is characterised by further comprising classifying means for analysing and classifying one or more of the selected signals into sound classes, wherein the extracting means and the classifying means are operationally connected to one another for transferring extracted source identification information and/or extracted audio type information.

A further embodiment of the hearing device according to the present invention is characterised in that the processing means is configured to modify each selected signal according to the hearing program assigned to the respective selected signal, thus yielding one or more modified signals, and in that the processing means further comprises weighting means for forming a weighted sum of the modified signals, wherein the weighting is at least partly dependent on at least one of the source identification information, the audio type information and the sound class.

A further embodiment of the hearing device according to the present invention is characterised in that the selecting means is configured to select the selected signals at least partly dependent on a selection priority list, wherein the selection priority list comprises assignments of priorities to the signal sources identifiable by the source identification information and/or the audio types identifiable by the audio type information, and/or in that the processing means is configured to process the selected signals at least partly dependent on a processing priority list, wherein the processing priority list comprises assignments of priorities to the signal sources identifiable by the source identification information and/or the audio types identifiable by the audio type information and/or combinations of both.

It should be expressly pointed out that the invention is not limited to instances where both source identification information and audio type information are available, but is equally applicable in cases where only one of these two kinds of information is available or is being extracted. Moreover, any combination of the above-mentioned embodiments, or combinations of combinations, is subject of a further combination. Only those combinations are excluded that would result in a contradiction.

BRIEF DESCRIPTION OF THE DRAWINGS

For the purpose of facilitating the understanding of the present invention, exemplary embodiments thereof are illustrated in the accompanying drawings which are to be considered in connection with the following description. Thus, the present invention may be more readily appreciated.

DETAILED DESCRIPTION OF THE INVENTION

Figure 1:
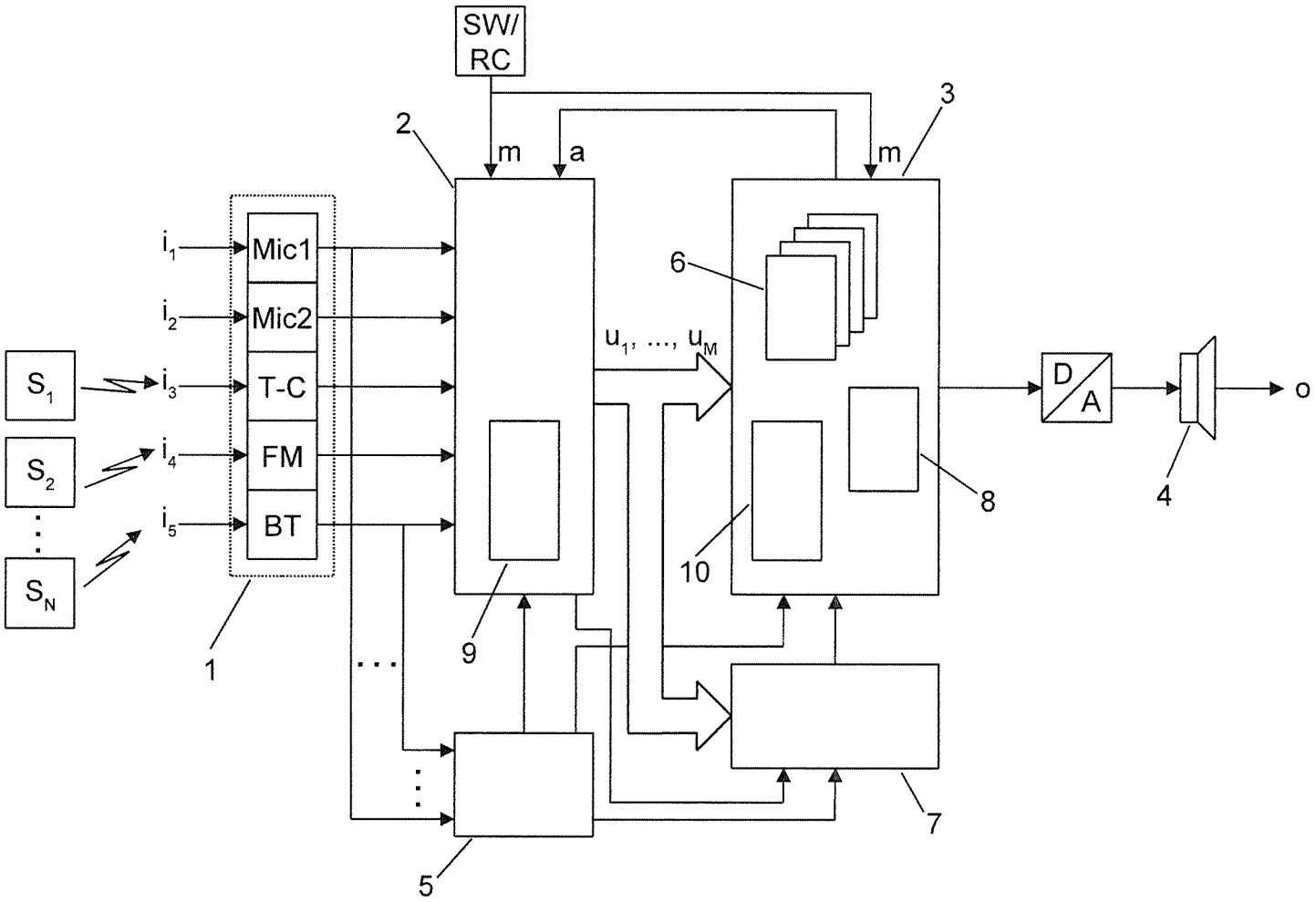
FIG. 1 shows a block diagram of a hearing device according to an embodiment the present invention in a schematic representation along with a number of external signal sources.

The hearing device depicted in FIG. 1 comprises input receiving means 1 capable of receiving a plurality of input signals $i_1, \ldots, i_5$. These input signals $i_1, \ldots, i_5$ are either audio, i.e. sound input signals $i_1, i_2$ originating from the local surroundings of the hearing device, or they are carrier input signals $i_3$, $i_4$, $i_5$ conveying audio signals from various remote signal sources $S_1, \ldots, S_N$ to the hearing device, whereby the audio signals are modulated onto the carrier input signals $i_3$, $i_4$, $i_5$. A broad range of equipment can act as signal sources $S_1, \ldots, S_N$ such as for instance portable multi-media players (e.g. MP3 players, CD players, DVD players), mobile telephones, personal digital assistants, personal computers, home entertainment systems, gaming units, navigation devices, companion/conference microphones, etc.

The sound input signals $i_1$, $i_2$ are picked up by a front and a back microphone, respectively, of the hearing device, which are part of the blocks labelled Mic1 and Mic2, respectively. The two microphones convert the sound signals into electrical signals which are subsequently digitised by means of analogue-to-digital converters (which are also part of the blocks Mic1 & Mic2) for the digital processing that follows.

Different transmission schemes can be employed to convey the audio signals from the remote signal sources $S_1, \ldots, S_N$ to the hearing device. For instance radio-frequency (RF) transmission according to the Bluetooth (BT) or Zigbee standard or based on frequency modulation (FM) as well as inductive transmission are commonly utilized.

The inductive carrier input signal $i_3$ from an inductive loop system $S_1$ is picked up by a T-coil (also referred to as telephone coil) contained in the block labelled T-C. This block further contains an inductive receiver as well as an analogue-to-digital converter to retrieve and digitise the audio signal conveyed by the carrier input signal $i_3$. Inductive loop systems are often employed to broadcast the signal from a speaker's microphone to multiple listeners, e.g. in churches, class rooms or conference centres. Inductive transmission is also increasingly being used for short-range links, e.g. ear-to-ear communication or body-area networks (BANs), in binaural hearing systems.

The FM carrier input signal $i_4$ for instance from a remote companion microphone $S_2$ is demodulated in the block labelled FM. This block contains an FM receiver as well as an analogue-to-digital converter to retrieve and digitise the audio signal conveyed by the carrier input signal $i_4$.

The Bluetooth carrier input signal $i_5$ from the Bluetooth device $S_N$ is demodulated in the block labelled BT. This block contains a Bluetooth receiver as well as an audio codec which provides the audio signal conveyed by the carrier input signal $i_4$ in digitised form. The use of Bluetooth devices to transmit various kinds of signals for different applications has become widespread. For instance Bluetooth transmission in conjunction with mobile telephones, portable multi-media players, personal computers, home entertainment systems (e.g. television and hi-fi stereo equipment), etc. is commonplace nowadays. It is therefore important to provide modern hearing devices with appropriate means to interconnect with such equipment, thus allowing the user of a corresponding hearing device to receive signals from a multitude of available Bluetooth devices.

From the plurality of input signals $i_1, \ldots, i_5$ typically only a subset is processed by the hearing device and subsequently provided to the user via an appropriate output generating means 4, such as a miniature loudspeaker (also referred to as receiver) or another kind of electro-mechanical transducer, e.g. cochlear or middle ear implant. The input signals $i_1, \ldots, i_5$ which are to be processed by the processing means 3 of the hearing device are selected in the selecting means 2 of the hearing device.

Signal selection in the selecting means 2 can be based on different inputs and various criteria. According to the present invention selecting of the input signal(s) $i_1, \ldots, i_5$ to be processed is based on information regarding the signal source $S_1, \ldots, S_N$ from which an input signal $i_3, \ldots, i_5$ originates and/or from information regarding the audio type being conveyed by an input signal $i_3, \ldots, i_5$. Such information is provided as part of the input signal $i_3, \ldots, i_5$. In the case of analogue signal transmission such as used for example with a T-coil or FM system, this information is for instance sent as a separate data signal or as a distinct indicator signal "along side" or "on top of" the carrier signal bearing the audio signal itself. In the case of digital data transmission, such as used for a Bluetooth link, the information is embedded in the data stream containing the audio signal. In both cases the source identification information identifying the signal source $S_1, \ldots, S_N$ from which a particular input signal $i_1, \ldots, i_5$ originates, and/or the audio type information indicating the type of audio content present in a particular input signal $i_1, \ldots, i_5$ is extracted from the input signals $i_1, \ldots, i_5$ by an extracting means 5, which provides the extracted information to the selecting means 2. The source identification information can either identify a single specific source for instance based on its individual and unique MAC (media access control) address, IMSI (international mobile subscriber identity) number, MSIN (mobile subscriber identity) number, IP (Internet protocol) address, telephone number, name (device or person to which it is associated), serial number or geographical position (e.g. coordinates or location address), or it can identify groups of identical or similar sources based on common source identification information such as sub-addresses, -domains, -names, etc. The audio type information can for instance be extracted from audio metadata (e.g. ID3 or APE tags) or from data from an RDS (radio data system) sent along with the audio signal as part of the input signal $i_1, \ldots, i_5$.

Moreover, the user also has the possibility to manually select an input signal $i_1, \ldots, i_5$ he wished to hear via a switch located on the hearing device itself (labelled SW) or via a separate accessory such as a remote control (labelled RC), the output of which is provided to the selecting means 2 via the input labelled 'm'. The remote control can for instance also be used to instruct the hearing device which one of a plurality of FM devices or Bluetooth devices is to be linked to the FM or BT block of the input receiving means 1. The hearing device then configures the FM or BT block accordingly, e.g. tunes to a specific FM carrier frequency or connects to a specific Bluetooth device using a specific Bluetooth profile (e.g. performs Bluetooth pairing).

Furthermore, the hearing device is able to select one or more input signals $i_1, \ldots, i_5$ automatically based on evaluating the input signals $i_1, \ldots, i_5$ and/or based on user preferences stored in the hearing device. For instance the hearing device detects the presence and determines the signal quality of the input signals $i_1, \ldots, i_5$ and subsequently selects only the input signals $i_1, \ldots, i_5$ having a signal quality above a certain threshold. The assessment of signal quality can either be performed by the selecting means 2 itself or by the processing means 3. In the latter case the feedback signal labelled 'a' from the processing unit 3 to the selecting unit 2 is used to indicate to the selecting unit 2 which input signal(s) $i_1, \ldots, i_5$ to select.

Additionally, the selection can be influenced by the block within the input means 1 which receives an input signal $i_1, \ldots, i_5$. For example the input signal $i_3$ is always selected as soon as the presence of a T-coil signal has been detected.

The selecting means 2 may also comprise a selection priority list 9. This selection priority list 9 assigns priorities to the individual input signals $i_1, \ldots, i_5$ depending on the signal source $S_1, \ldots, S_N$ from which they originate and/or the audio type of the audio signal being carried by them. So for instance the input signal $i_5$ originating from a mobile phone always takes precedence over the input signal $i_3$ originating from an inductive loop system of a conference room. In another example an alarm (=specific audio type) relayed to the hearing device via an FM link as part of the input signal $i_4$ takes precedence over music (=another specific audio type) received over the Bluetooth link from a personal audio player.

The assignment of priorities in the selection priority list 9 is performed during fitting of the hearing device to the needs and requirements of the user. Moreover, the selection priority list 9 can be modified by the user during use of the hearing device, in that the hearing device adapts itself to the preferences of the user based on the manual inputs of the user, i.e. the user interaction. The hearing device thus learns the preferences of the user by analysing the user interactions and changes its behaviour accordingly, for instance by changing the priorities assigned in the selection priority list 9. As soon as the change is in-line with the user's preference the user will consequently no longer need to correct the automatic behaviour of the hearing device through manual intervention.

The selected signals $u_1, \ldots, u_M$ are subsequently processed by the processing means 3. For this processing the processing means 3 provides a plurality of hearing programs 6. Each hearing program 6 comprises specific signal processing routines as well as related parameter settings which optimally, i.e. according to the user's requirements and preferences, adapt the operation of the hearing device to a given listening situation such as for instance a certain sound environment or a certain audio type. Thus, whenever a certain listening situation is encountered the hearing device applies the corresponding hearing program 6 to the selected input signal $u_1, \ldots, u_M$. In order to achieve this the hearing device must be capable of determining the present listening situation associated with a specific selected signal $u_1, \ldots, u_M$. This is made possible by the present invention by selecting a certain hearing program 6 dependent on the source identification information and/or the audio type information associated with a particular selected signal $u_1, \ldots, u_M$. This information is provided to the processing means 3 from the extracting means 5. Accordingly, a hearing program 6 is for instance associated with at least one of the signal sources $S_1, \ldots, S_N$ identifiable by the source identification information. Alternatively, a hearing program 6 is for instance associated with at least one of the audio types identifiable by the audio type information. Moreover, a hearing program 6 may for instance also be associated with both a signal source $S_1, \ldots, S_N$ as well as an audio type. This is useful in cases where different audio types originate from the same signal source $S_1, \ldots, S_N$ at different times.

The associating of hearing programs 6 to signal sources $S_1, \ldots, S_N$ and audio types is performed during the fitting of the hearing device to the needs and preferences of the user. This is typically done be a hearing health care professional such as an audiologist. Moreover, these assignments may be modified later during use of the hearing device in response to the user's manual interventions, i.e. the user interactions with the hearing device. The user is able to change the selected hearing program via a switch located on the hearing device or on a remote control (referred to as SW & RC, respectively). Systematic manual changes by the user are registered by the hearing device and over time the hearing device learns from these interactions that the user's preference does not match with the present association of hearing program with signal source $S_1, \ldots, S_N$ and/or audio type. Accordingly, the hearing device subsequently modifies this association so that it is adapted to the user's preference, and the user no longer has to change the hearing program selected by the hearing device.

The automatic selection of an appropriate hearing program may be further supported by a classifying means 7, which analyses and classifies one or more of the selected signals $u_1, \ldots, u_M$ into sound classes. A hearing program is then associated with each sound class, for the processing of which it is specifically optimised. The classification process may thereby be supported by providing source identification information and/or audio type information to the classifying means 7 from the extracting means 5. The classification process may be supported additionally by providing information regarding the block within the input receiving means 1 from which a specific selected signal $u_1, \ldots, u_M$ originates from, i.e. if it was picked up by one of the microphones Mic1, Mic2, by the T-coil, or received via an FM or Bluetooth link.

When multiple selected signals $u_1, \ldots, u_M$ are processed simultaneously, each selected signal $u_1, \ldots, u_M$ is for instance processed according to an certain hearing program 6, thus yielding modified signals. Subsequently, these modified signals are combined to form a single signal which is then applied to a digital-to-analogue converter and to an output generating means 4 such as a receiver or other type transducer as indicated above, which outputs the signal labelled 'o'. The combining of the modified signals is performed by an appropriate weighting means 8, which weights each of the modified signals with a corresponding weighting coefficient and then adds together the resulting weighted modified signals. The weighting coefficients may thereby be partly dependent on the extracted source identification information and/or the extracted audio type information. This makes it possible to emphasise those modified signals originating from specific signal sources $S_1, \ldots, S_N$ and/or those comprising certain audio types. This is desirable for instance in a situation where the hearing device user is primarily making a phone call via the Bluetooth link and simultaneously still wants to listen to another speaker via the FM link in the background, or when primarily listening to a speaker via the FM link whilst concurrently still wanting to hear in the background music from a home entertainment system via the Bluetooth link.

The processing of the selected signals $u_1, \ldots, u_M$ may be dependent on a processing priority list 10. This processing priority list 10 assigns a processing priority to the signal sources $S_1, \ldots, S_N$ identifiable by the source identification information and/or to the audio types identifiable by the audio type information and/or combinations of both. Depending on the priority of a signal originating from a certain signal source $S_1, \ldots, S_N$ or of a certain audio type or of a signal of a certain audio type originating from a certain signal source $S_1, \ldots, S_N$ its processing may take precedence over another signal which has been assigned a lower priority. Especially if processing power is limited, for instance due to power constraints when the hearing device battery is almost depleted, it is advantageous to allocate the available resources to the most important signals or those most preferred by the user. As was already elaborated upon above on conjunction with the selection priority list, the assigning of priorities initially takes place as part of a hearing device fitting process, but these initial assignments may be modified, i.e. updated later on during use of the hearing device based on the user's interactions with the hearing device, from which the hearing device automatically learns new, more preferable priority assignments.

Figure 2:
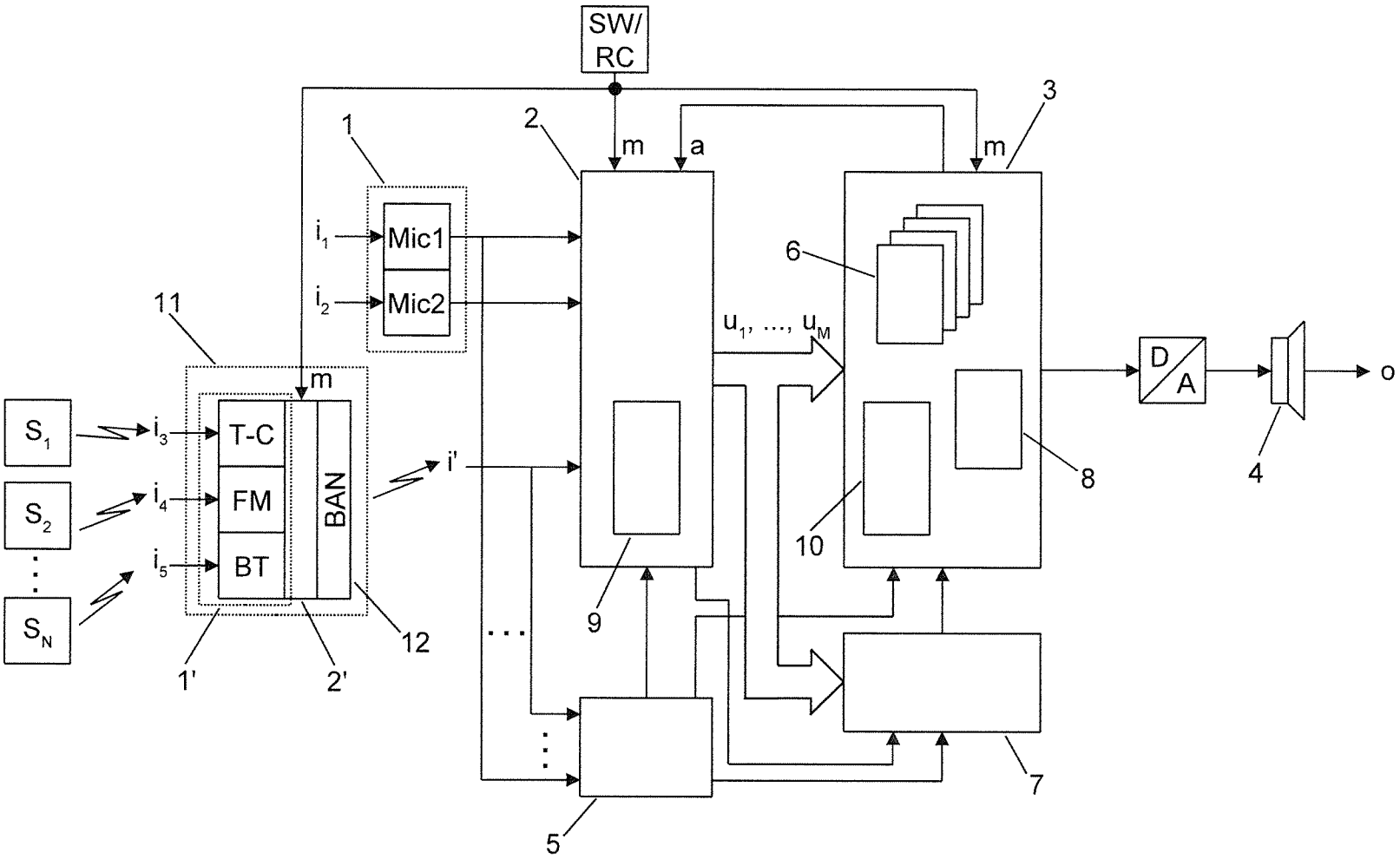
FIG. 2 shows a block diagram of a hearing device comprising a remote auxiliary unit according to a further embodiment the present invention in a schematic representation along with a number of external signal sources.

The hearing device depicted in FIG. 2 includes a separate, remote auxiliary unit 11, such as a hub which acts as a communication relay. The remote auxiliary unit 11 can for instance be attached to a necklace or a waistbelt at a distance to the other part(s) of the hearing device worn at the ear(s). With such a configuration the hearing device comprises more than one input receiving means 1, 1' each capable of receiving one or more input signals $i_1, \ldots, i_5$, i'. The input receiving means 1' at the remote auxiliary unit 11 thereby receives the input signals $i_3, \ldots, i_5$ sent wirelessly from such sources as an inductive loop system $S_1$, a remote companion microphone $S_2$, or a mobile telephone $S_N$. A signal source such as an portable audio (MP3) player can however also be connected via a wired connection to an input of the remote auxiliary unit 11. The remote auxiliary unit 11 then pre-selects one (or possibly more than one) of theses input signals $i_3, \ldots, i_5$ via the pre-selecting means 2' and then sends the selected signal(s) i' to the ear-level part of the hearing device with the help of a short-range communication means 12 such as a body-area network (BAN) transmitter. The pre-selection of the input signal(s) i' to be passed on to the ear-level part of the hearing device can be determined by a manual selection performed by the user of the hearing device and fed to the pre-selecting means 2' via the input labelled 'm' from a switch (SW) or a button on a remote control unit (RC). Alternatively, the pre-selection can also be performed automatically by the pre-selecting means 2' itself based on a selection priority list as previously mentioned or based on signal strength or quality. At the ear-level part of the hearing device the subsequent operations performed on the input signals $i_1$, $i_2$ and i', i.e. the steps of extracting source identification and/or audio type information, selecting signals to be processed and processing these selected signals is carried out in the same way as described above in conjunction with the hearing device according to FIG. 1.

Finally, a specific example is given of a way in which audio type information can be derived at a television set in order to be provided to the hearing device along with the audio signal. In this case the audio type information is derived from an electronic program guide which is commonly provided with the distribution of digital television signals. Such an electronic program guide includes exact information as to what television program is being transmitted at a certain time over a certain channel. From this information the primary audio content of the audio signal associated with a specific television program can be determined. This audio type information, e.g. if the current television program is a pop concert, a talk show, a newscast or an action film with loud sound effects, is then send together with the audio signal to the user of a hearing device, for instance via a Bluetooth link from the television set a hub and then via inductive short-range transmission from the hub to the ear-level part(s) of the hearing device.

The invention claimed is:

1. A method for operating a hearing aid capable of receiving a plurality of input signals, the method comprising the steps of:

extracting source device identification information embedded in one or more of the input signals, wherein the source device identification information identifies a specific signal source device from which a particular input signal originates;

selecting from the plurality of input signals one or more selected signals to be processed;

processing the selected signals using one or more hearing programs; and generating an output signal of the hearing aid by said processing of the selected signals;

wherein the step of selecting is at least partly dependent on the extracted source device identification information, or wherein the step of processing is at least partly dependent on the extracted source device identification information, wherein said source device identification information that identifies the specific signal source device is at least one of the following:

a media access control address;

an international mobile subscriber identity number;

a mobile subscriber identity number;

an Internet protocol address;

a telephone number;

a person's or device's name;

a serial number; and a geographical position.

2. The method according to claim 1, wherein a hearing program is associated with one or more signal source devices identifiable by the source device identification information.

3. The method according to claim 2, wherein the associating the hearing program with a signal source device is performed prior to use of the hearing aid by a user of the hearing aid as part of a hearing aid fitting process.

4. The method according to one of claims 2 or 3, wherein the associating of the hearing program with a signal source device is modified dependent on user interaction with the hearing aid during use of the hearing aid.

5. The method according to claim 1, wherein the step of processing is at least partly dependent on a further step of analysing and classifying one or more of the selected signals into sound classes, wherein a hearing program is associated with each sound class.

6. The method according to claim 5, wherein the step of analysing and classifying takes into account the source device identification information extracted from the respective selected signal.

7. The method according to claim 5, wherein the step of processing comprises modifying each of the selected signals according to the hearing program associated with the signal source device identified by the source device identification information embedded in the respective selected signal, thus yielding one or more modified signals, and forming a weighted sum of the one or more modified signals, wherein the weighting is at least partly dependent on at least one of the extracted source device identification information and the sound class.

8. The method according to claim 1, wherein the step of selecting is at least partly dependent on a selection priority list, wherein the selection priority list comprises assignments of priorities to the signal source devices identifiable by the source device identification information, or that the processing of the selected one or more signals is at least partly dependent on a processing priority list, wherein the processing priority list comprises assignments of priorities to the signal source devices identifiable by the source device identification information.

9. The method according to claim 8, wherein the assigning of priorities to the signal source devices as provided by the selection priority list or the processing priority list is performed prior to use of the hearing aid by a user of the hearing aid as part of a hearing aid fitting process.

10. The method according to one of claims 8 or 9, wherein the assigning of priorities to the signal source devices as provided by the selection priority list or the processing priority list is modified based on user interaction with the hearing aid during use of the hearing aid.

11. A hearing aid comprising:

input receiving means for receiving a plurality of inputs signals;

selecting means for selecting from the plurality of input signals one or more selected signals to be processed;

processing means for processing the selected signals, the processing means being adapted to process the selected signals using one or more hearing programs; and output generating means for generating an output signal of the hearing aid by said processing of the selected signals;

extracting means for extracting source device identification information embedded in one or more of the input signals, wherein the source device identification information identifies a specific signal source device from which a particular input signal originates;

wherein the extracting means and selecting means are operationally connected to one another for transferring extracted source device identification information or audio type information, or wherein the extracting means and the processing means are operationally connected to one another for transferring extracted source device identification information, wherein said source device identification information that identifies the specific signal source device is at least one of the following:

a media access control address;

an international mobile subscriber identity number;

a mobile subscriber identity number;

an Internet protocol address;

a telephone number;

a person's or device's name;

a serial number; and a geographical position.

12. The hearing aid according to claim 11, characterised in that the processing means provides a plurality of hearing programs, wherein at least one hearing program is selectable dependent on the extracted source device identification information.

13. The hearing aid according one of the claim 11 or 12, further comprising classifying means for analysing and classifying one or more of the selected signals into sound classes, wherein the extracting means and the classifying means are operationally connected to one another for transferring extracted source device identification information.

14. The hearing aid according to claim 13, characterised in that the processing means is configured to modify each selected signal according to the hearing program assigned to the respective selected signal, thus yielding one or more modified signals, and in that the processing means further comprises weighting means for forming a weighted sum of the modified signals, wherein the weighting is at least partly dependent on at least one of the source device identification information and a sound class.

15. The hearing aid according to claim 11, characterised in that the selecting means is configured to select the selected signals at least partly dependent on a selection priority list, wherein the selection priority list comprises assignments of priorities to the signal source devices identifiable by the source device identification information, or in that the processing means is configured to process the selected signals at least partly dependent on a processing priority list, wherein the processing priority list comprises assignments of priorities to the signal source devices identifiable by the source device identification information.

* * * * *